US006755175B1

(12) United States Patent
McKay et al.

(10) Patent No.: US 6,755,175 B1
(45) Date of Patent: Jun. 29, 2004

(54) DIRECT INJECTION OF FUELS IN INTERNAL COMBUSTION ENGINES

(75) Inventors: Michael Leonard McKay, Kardinya (AU); Mark Douglas Archer, Subiaco (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 68 days.

(21) Appl. No.: 10/110,211

(22) PCT Filed: Oct. 18, 2000

(86) PCT No.: PCT/AU00/01266

§ 371 (c)(1),
(2), (4) Date: May 28, 2002

(87) PCT Pub. No.: WO01/29406

PCT Pub. Date: Apr. 26, 2001

(30) Foreign Application Priority Data

Oct. 18, 1999 (AU) ..... PQ3501
Oct. 18, 1999 (AU) ..... PQ3502
Oct. 22, 1999 (AU) ..... PQ3607

(51) Int. Cl.[7] ..... F02M 57/06
(52) U.S. Cl. ..... 123/297; 123/305
(58) Field of Search ..... 123/297, 305

(56) References Cited

U.S. PATENT DOCUMENTS 4,095,580 A 6/1978 Murray et al.
4,967,708 A * 11/1990 Linder et al. ..... 123/297

(List continued on next page.)

FOREIGN PATENT DOCUMENTS

EP 0 918 155 A2 5/1999
GB 2 233 390 A 1/1991

(List continued on next page.)

OTHER PUBLICATIONS

Derwent Abstract Accession No. 96–206609/21, Class Q53, Q54, JP 08–074 703 A (Nippon Jidosha Bushin Sogo) Mar. 19, 1996.

(List continued on next page.)

*Primary Examiner*—Erick Solis
(74) *Attorney, Agent, or Firm*—Rothwell, Figg, Ernst & Manbeck, P.C.

(57) ABSTRACT

A fuel delivery injector for a spark-ignition internal combustion engine. The delivery injector forms part of a device (10) which provides a combined fuel injection and ignition means for the engine. The fuel delivery injector comprises means defining a flow path (28) for delivery of a fuel entrained in a gas to a combustion chamber of the engine. The flow path (28) has a delivery port (30) through which the fuel is delivered into the combustion chamber as a spray of fuel droplets and vapour, the delivery port (30) being defined between a valve seat (31) and a valve member (23) movable with respect to the valve seat (31) for opening and closing the delivery port (30). The delivery injector is configured to influence the trajectory of the fuel spray, whereby smaller fuel droplets and vapour in the fuel spray are caused to flow towards a spark gap (49) in close proximity to the downstream end of the delivery port (30) and whereby larger fuel droplets are not so caused to flow towards the spark gap (49). The trajectory of the fuel spray may be so influenced by the presence of a flow control means or the configuration of the delivery port. Where a flow control means is utilized, it may comprise a flow control projection (41) which is provided on the valve member (23) and which extends outwardly therefrom beyond the delivery port (30). Where the device (10) provides a combined fuel injector and ignition means, the device (10) is provided with a primary electrode (48) which cooperates with a secondary electrode (47) to define the spark gap (49). The flow control projection (41) is utilized to define the primary electrode (48). The device (10) providing the combined fuel injection and ignition means is also described and claimed.

39 Claims, 4 Drawing Sheets

U.S. PATENT DOCUMENTS

| | | | | | |
|---|---|---|---|---|---|
| 4,982,708 | A | * | 1/1991 | Stutzenberger | 123/297 |
| 5,195,482 | A | * | 3/1993 | Smith | 123/305 |
| 5,497,744 | A | * | 3/1996 | Nagaosa et al. | 123/297 |
| 5,531,199 | A | * | 7/1996 | Bryant et al. | 123/297 |
| 5,551,638 | A | * | 9/1996 | Caley | 239/453 |
| 5,715,788 | A | * | 2/1998 | Tarr et al. | 123/297 |
| 5,730,100 | A | * | 3/1998 | Bergsten | 123/297 |
| 5,833,142 | A | * | 11/1998 | Caley | 239/453 |
| 5,983,855 | A | * | 11/1999 | Benedikt et al. | 123/297 |
| 2003/0111042 | A1 | * | 6/2003 | Rieger et al. | 123/297 |
| 2004/0011326 | A1 | * | 1/2004 | Yamashita et al. | 123/305 |

FOREIGN PATENT DOCUMENTS

| | | | |
|---|---|---|---|
| GB | 2 295 204 A | | 5/1996 |
| JP | 63-154760 | * | 10/1998 |

OTHER PUBLICATIONS

Derwent Abstract Accession No. 99–176136/15, Class Q53, Q54, JP 11–030124 A (Nippon Jidosha Buhin Sogo) Feb. 2, 1999.

* cited by examiner

DIRECT INJECTION OF FUELS IN INTERNAL COMBUSTION ENGINES

TECHNICAL FIELD

This invention relates to direct injection of fuels in internal combustion engines. More particularly, the invention relates to an apparatus and method for direct injection of fuels into spark-ignition internal combustion engines. The invention also relates to a combined fuel injection and ignition means for spark-ignition internal combustion engines.

BACKGROUND OF THE INVENTION

For a spark-ignition internal combustion engine having fuel directly injected into a combustion chamber, it is highly desirable to introduce the fuel into the combustion chamber in a form conducive to effect reliable and repeatable ignition. Typically, this requires that fuel droplets present at a spark gap in the combustion chamber are of a suitable size to provide favourable ignition conditions, and to avoid both quenching of either one or both of the electrodes which define the spark gap and insulation of either one or both of the electrodes by the fuel. This requirement can in certain applications be difficult to achieve, particularly where the fuel injector is combined into a single assembly with the ignition means.

Examples of arrangements involving combined fuel injection and ignition means are disclosed in U.S. Pat. No. 4,967,708 (Under et al), EP 0 632 198 (Suzuki), U.S. Pat. No. 5,497,744 (Nagaosa et al), and U.S. Pat. No. 5,730,100 (Bergsten).

Bergsten discloses an injector arrangement for injection of fuel and ignition of the resultant air-fuel mixture in the combustion chamber of a reciprocating-piston engine. The injector arrangement includes a valve housing, a valve needle and a valve element, all of which are made of electrically conductive material and which together form an electrode positioned centrally in the injector arrangement, so constituting a single-pole ignition plug. The second electrode is operatively attached to the piston or to the cylinder in which the piston reciprocates. With this arrangement, the injector delivers fuel into the combustion chamber, and co-operation between the electrode on the injector and the second electrode within the combustion chamber creates a spark gap at which an ignition spark can be established in timed sequence with operation of the engine. This arrangement enables fuel to be delivered into the combustion chamber as a single fluid in the form of a spray or cloud of fuel droplets, but not necessarily in a manner which regulates the dispersion and flow of fuel to the spark gap so as to facilitate a reliable ignition process and avoid quenching of the electrodes.

Further, due to physical limitations, it is often difficult if not impossible to arrange the spark gap of a suitable ignition means at the most optimum point within the combustion chamber. For example, in certain applications the optimum area for ignition may be 'out of reach' of a conventional ignition means. This may hence require the use of specially modified ignition means such as long reach spark plugs or unique orientations thereof within the cylinder head of an engine. In turn, this may result in increased cost and other engineering and durability issues which may be difficult to overcome.

It is against this background, and the problems and difficulties associated therewith, that the present invention has been developed. Specifically, it is an object of the present invention to provide a fuel delivery injector which delivers fuel to a spark gap in a manner which provides conditions conducive to effect reliable ignition.

SUMMARY OF THE INVENTION

The present invention provides a fuel delivery injector for a spark-ignition internal combustion engine, the fuel delivery injector comprising means defining a flow path for delivery of a fuel entrained in a gas to a combustion chamber of the engine, the flow path having a delivery port through which the fuel is delivered into the combustion chamber as a spray of fuel droplets and vapour, the delivery port being defined between a valve seat and a valve member movable with respect to the valve seat for opening and closing the delivery port, the delivery injector being configured to influence the trajectory of the fuel spray whereby smaller fuel droplets and vapour in the fuel spray are caused to flow towards a spark gap in close proximity to the downstream end of the delivery port and whereby larger fuel droplets are not so caused to flow towards the spark gap.

Preferably, the fuel delivery injector includes a flow control means disposed outwardly of the delivery port in the direction of issuance of the fuel spray, the flow control means being configured and positioned to influence the trajectory of the fuel spray whereby smaller fuel droplets and vapour in the fuel spray are caused to flow towards the spark gap in the vicinity of the control means.

With this arrangement, the spark gap is able to be located in the region downstream of the delivery port where the small fuel droplets and vapour are more prevalent, this area and such conditions being more favourable to reliable and repeatable ignition. In effect, the larger fuel droplets which are likely to inhibit the ignition process at the spark gap are separated from the smaller droplets in the gaseous stream, the larger droplets continuing to follow a trajectory established upon exit from the delivery port by virtue of their momentum.

Alternatively, or additionally, the flow control means may comprise or further comprise the delivery port.

Preferably, the flow control means comprises a flow control projection supported on the valve member and extending outwardly therefrom beyond the delivery port. The smaller droplets and vapour are guided by the profile of the projection in accordance with the Coanda Effect. That is, the small droplets and vapour are drawn inwards towards the surface of the projection such that a certain degree of 'necking in' of the fuel spray occurs. It should however be noted that, in certain applications, a similar effect may result even though there is no flow control projection provided downstream of the valve member. In such cases, it is believed that the small fuel droplets and vapour are drawn inwardly following their delivery into the combustion chamber due to the presence of a generally low pressure area immediately beneath the valve member of the fuel delivery injector.

The projection may, for example, have a profile as disclosed in U.S. Pat. No. 5,551,638, or U.S. Pat. No. 5,833,142, both of which have been assigned to the Applicant and the contents of which are incorporated herein by way of reference. The projection may be formed integrally with the valve member, or it may be detachable therefrom, such as for example, by way of a screw-threaded connection.

Where the injector forms part of a combined injection and ignition means, the control projection may define a first electrode which co-operates with a second electrode to define the spark gap. The first electrode defined by the control projection is preferably a primary electrode, in which case the second electrode defines a secondary electrode. The two electrodes can be so disposed relative to one another such that the spark gap defined therebetween can provide either a radial gap or an axial gap. If desired, there may be more than one said second electrode, in which case the second electrodes may conveniently be circumferentially spaced about the primary or central electrode defined by the control projection. In certain applications where a projection is not provided downstream of the valve member, or as an alternative arrangement where a control projection does exist, the valve member itself may be configured as the first electrode with the spark gap being provided between the valve member of the injector and the second electrode(s).

By having the spark gap defined by the projection or the valve member, the location of the spark gap within the region of small fuel droplets and vapour formed by the fuel delivery injector is effectively ensured. This is due to the effect of the delivery port and/or the flow control projection which facilitate the smaller fuel droplets and vapour in the fuel spray being attracted to the area in close proximity to the downstream end of the delivery port where the spark gap is arranged.

In the case where the spark gap is configured as a radial gap between the projection or valve member and the secondary electrode(s), certain benefits may be realised for the injector. Firstly, the combined injection and ignition means will generally be slightly shorter over its entire length as no element needs to be provided downstream of the control projection to provide the spark gap. Secondly, as a range of, or changing profile of air-fuel ratios, is likely to exist substantially perpendicularly to the direction of fuel flow into the cylinder, a spark across a radial gap is potentially more likely to traverse across a greater number of these air-fuel ratios and hence the likelihood of ignition of the fuel-air charge occurring is increased. This is particularly applicable in stratified charge or lean burn engines where such a range of air-fuel ratios are likely to exist in the fuel spray delivered into the combustion chamber by the injector.

Preferably, ignition of the fuel-air charge in the combustion chamber is able to occur directly off the fuel spray which issues from the delivery injector. That is, it is not necessary for the fuel spray to be reflected or deflected off other components, such as for example, a piston bowl, in the combustion chamber before ignition can be effected. Conveniently, ignition occurs off the inner part of the fuel spray. That is, ignition is effected in the area immediately adjacent the control projection or the central region of the combustion chamber as opposed to the outer parts or periphery of the fuel spray.

Preferably, the fuel delivery injector is arranged to deliver fuel entrained in gas directly into the combustion chamber of the engine. Such gas or air-assisted injection is particularly conducive to the establishment of a stratified fuel-air distribution in the combustion chamber. Conveniently, the delivery injector is of the outwardly opening or poppet type. Preferably, the delivery port comprises an annular passage divergent in the direction of flow of the fuel entrained in the gas. It is particularly advantageous for the annular passage defining the delivery port to be of a construction which includes a constricted section defining a minimum choke area and a divergent section downstream of the constricted section defining a divergent nozzle. Such a construction assists in the creation of small droplets of fuel in the fuel spray exiting from the injector. This construction may be achieved by providing the valve seat as an annular surface of frusto-conical form so as to provide the divergent characteristic. The valve member may be provided with a sealing face of arcuate formation confronting the valve seat.

The fuel delivery injector may also include a valve housing defining a valve having a valve stem, the valve member being mounted on one end of the valve stem. The valve stem may be accommodated within a bore within the valve housing. Conveniently, the valve seat is provided about the bore at the combustion chamber end of the valve housing.

The invention also provides a combined fuel injection and ignition means for a spark-ignition internal combustion engine, the combined fuel injection and ignition means comprising means defining a flow path for delivery of a fuel entrained in a gas to a combustion chamber of the engine, the flow path having a delivery port through which the fuel is delivered into the combustion chamber as a spray of fuel droplets and vapour, the delivery port being defined between a valve seat and a valve member movable with respect to the valve seat for opening and closing the delivery port, a first electrode for co-operation with a second electrode to form a spark gap, and a flow control means for influencing the trajectory of the fuel spray issuing from the delivery port whereby smaller fuel droplets and vapour in the fuel spray are caused to flow towards the spark gap and whereby larger fuel droplets are not so caused to flow towards the spark gap.

The flow control means may comprise a flow control projection provided on the valve member and extending outwardly of the delivery port in the direction of issuance of the fuel spray. Alternatively, or additionally, the flow control means may comprise or further comprise the delivery port.

The second electrode may form part of the combined fuel injection and ignition means, or it may exist separately thereof. Where the second electrode is provided as part of the combined fuel injection and ignition means, the second electrode is preferably configured and positioned to provide a radial spark gap. Hence, such a dual pole ignition plug would enable ignition to be effected directly off the inner region of the issuing fuel spray.

The invention also provides a combined fuel injection and ignition means for a spark-ignition internal combustion engine, the combined fuel injection and ignition means comprising means defining a flow path for delivery of a fuel entrained in a gas to a combustion chamber of the engine, the flow path having a delivery port through which the fuel is delivered into the combustion chamber as a spray of fuel droplets and vapour, the delivery port being defined between a valve seat and a valve member movable with respect to the valve seat for opening and closing the delivery port, a flow control projection arranged on the valve member and extending outwardly of the delivery port in the direction of issuance of the fuel spray, the flow control projection defining an electrode which in co-operation with a further electrode forms a spark gap, the delivery port and/or the control projection being configured and positioned to influence the trajectory of the fuel spray whereby smaller fuel droplets and vapour in the fuel spray are caused to flow towards the spark gap and whereby larger fuel droplets are not so caused to flow towards the spark gap.

The invention also provides a method of injecting fuel into an internal combustion engine having a combustion chamber and a spark gap for spark-ignition of the fuel delivered into the combustion chamber, the method comprising the acts of: delivering a metered quantity of fuel entrained in a gas to the combustion chamber through a selectively openable delivery port to provide a fuel spray issuing from the port when opened; and controlling the fuel spray to influence fuel vapour and smaller fuel droplets to flow towards the spark gap while not so influencing larger droplets whereby the larger droplets continue on trajectories which do not lead to the spark gap.

The fuel spray may be so controlled by subjecting it to a flow control means positioned downstream of the delivery port. The fuel spray may also or alternatively be so controlled by virtue of the configuration of the delivery port.

BRIEF DESCRIPTION OF THE DRAWINGS

The invention will be understood by reference to the following description of several specific embodiments thereof as shown in the accompanying drawings in which.

BEST MODES OF CARRYING OUT THE INVENTION

Figure 1:
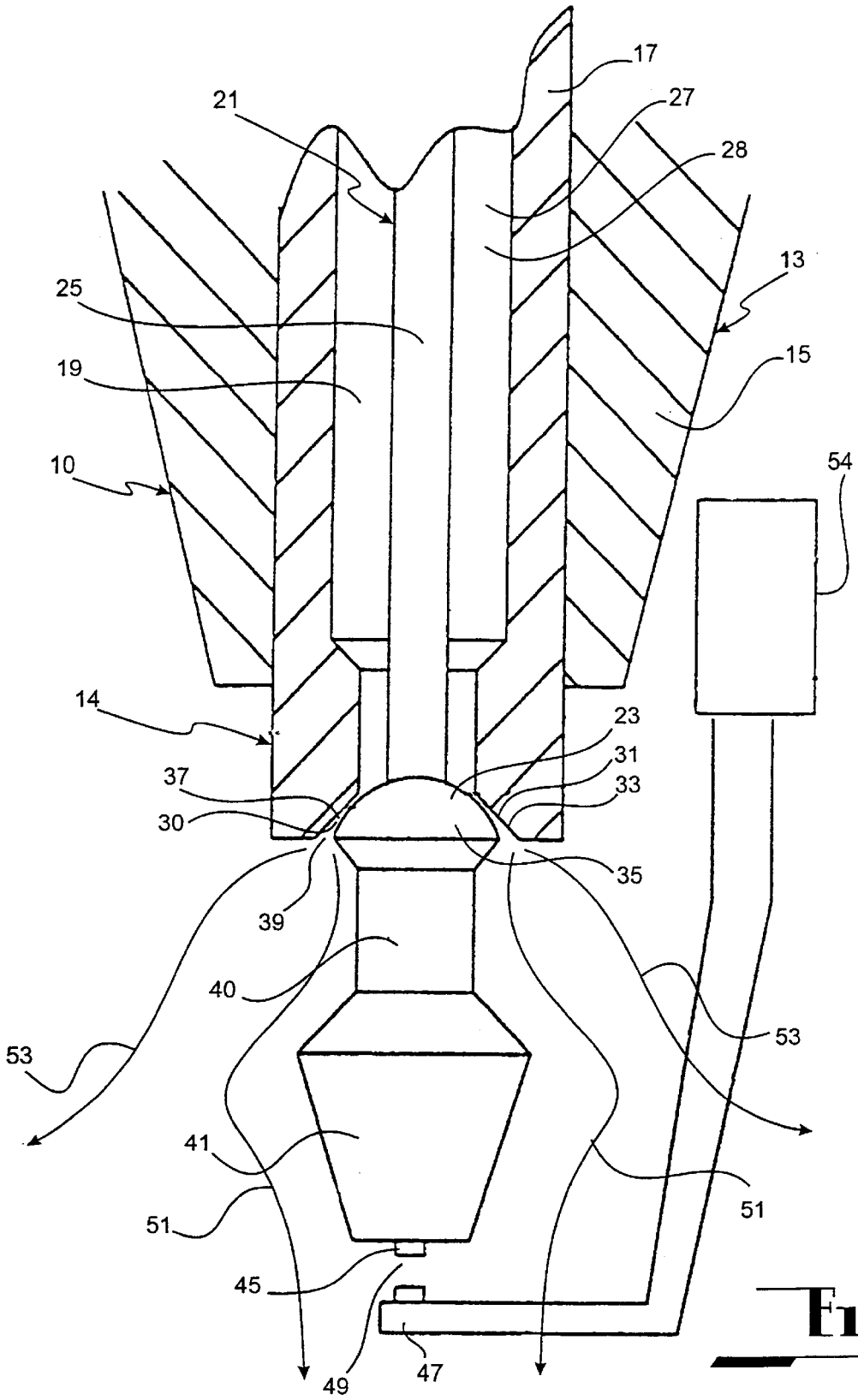
FIG. 1 is a fragmentary schematic view of the discharge end of a combined injection and ignition means according to the first embodiment, showing schematically the flow pattern of fuel spray issuing therefrom.

Referring to FIG. 1 of the drawings, the device 10 according to the first embodiment provides a combined fuel injection and ignition means for a reciprocating piston, spark-ignition internal combustion engine (not shown) having one or more combustion chambers into which fuel is delivered by way of a dual fluid direct injection process.

The device 10 comprises a body 13 having a delivery end section 14, and an external thread formation (not shown) to permit threading of the device 10 into a conventional spark plug hole in the head of the engine with the delivery end section 14 opening into the combustion chamber. The body 13 accommodates a ceramic insulator 15 surrounding a valve housing 17 having a central bore 19. A valve 21 is accommodated in the central bore 19 of the valve housing 17. The valve 21 has a valve member 23 at one end of a valve stem 25. The valve stem 25 is guided for reciprocatory movement within the bore 19 by any suitable means (not shown). The valve stem 25 is smaller in size than the bore 19 such that an annular passage 27 is defined between the valve stem 25 and the side wall of the bore 19. The annular passage 27 defines a flow path 28 for delivery of a fuel entrained in a gas to the combustion chamber of the engine. The gas in which the fuel is entrained is preferably an oxidant such as air. The workings of a dual fluid fuel injection system in which fuel is delivered entrained in air are disclosed, for example, in the Applicant's U.S. Pat. No. 4,693,224 and U.S. Pat. No. RE 36,768, the contents of which are incorporated herein by way of reference, and as such will not be expanded upon further herein.

The valve member 23 co-operates with a valve seat 31 provided in the valve housing 17 at the delivery end of the flow path 28. The valve member 23 and the valve seat 31 co-operate to define a delivery port 30. The valve seat 31 comprises an annular surface or face 33 of frusto-conical form. The valve member 23 of device 10 is of the outwardly opening or poppet-type, although other suitable arrangements may equally be used. However, such outwardly opening valves are particularly suited to the present invention and dual fluid fuel injection systems in that they enable the provision of a more desirable fuel dispersion and distribution effect in regard to the fuel spray issuing from the delivery port 30.

The valve member 23 has a sealing face 35 moveable into an out of sealing engagement with the valve seat 31 for opening and closing the delivery port 30. With this arrangement, a metered quantity of fuel entrained in the gas is delivered to the combustion chamber through the selectively openable delivery port 30 to provide a fuel spray issuing from the delivery port 30 when opened.

The direction and shape of the fuel spray issuing from the delivery port 30 is in part determined by the arrangement of the annular surface 33 and the face 35 of the valve member 23. Together, the face 35 and surface 33 typically serve to create a fuel plume having a conical or bell shaped configuration in the combustion chamber. This aspect will be further expanded upon hereinafter.

The delivery port 30 is opened and closed by movement of the valve member 23 relative to the valve seat 31. A drive unit (not shown) is provided for operating the valve 21 to move the valve member 23 into and out of engagement with the valve seat 31. The drive unit may, for example, comprise an electromagnetic means disposed within the body 13 and operably connected to the valve stem 25, whereby the valve member 23 is moved to open and close the port 30 as the electromagnetic means is selectively energised and de-energised. Any other suitable types of drive unit or drive system may be used and include, for example, piezoelectric, hydraulic and mechanical arrangements.

The delivery port 30 comprises an annular passage between the annular face 33 of the valve seat 31 and the arcuate sealing face 35 of the valve member 23. With this arrangement, the annular passage defining the delivery port 30 is of a construction which includes a constricted section 37 defining a minimum choke area, and a divergent section 39 downstream of the constricted section 37 defining a divergent nozzle.

A flow control projection 41 is provided on and downstream of the valve member 23. The flow control projection 41 extends axially from the valve member 23 in the direction of issuance of fuel spray from the delivery port 30. The flow control projection 41 may be attached to the valve member 23 by any suitable means. In the embodiment of FIG. 1, the projection 41 is connected to the valve member 23 by way of a necked-in portion 40.

The flow control projection 41 has a profile which presents an exterior surface as disclosed in the aforementioned U.S. Pat. No. 5,551,638. With such a profile, the flow control projection 41 influences the trajectory of the fuel spray issuing from the delivery port 30, as will be described in more detail later. Other suitable profiles may of course be used and some alternatives are disclosed, for example, in the aforementioned U.S. Pat. No. 5,833,142.

The outermost end of the flow control projection 41 defines a primary electrode 45, which together with a secondary electrode 47, defines a spark gap 49 therebetween. The spark gap 49 is disposed axially with respect to the flow control projection 41 in this embodiment. A high voltage electric circuit (not shown) is provided to selectively establish a voltage potential difference between the primary electrode 45 and the secondary electrode 47, thereby to create an ignition spark across the spark gap 49. The high voltage current for establishing the voltage potential at the primary electrode 45 is delivered to that electrode by way of the valve 21. Consequently, the valve 21 and the valve housing 17 are insulated by the ceramic insulator 15. The secondary electrode 47 may be formed as part of the device 10, however, it may alternatively be arranged on other suitable components or elements of the engine, such as for example, the cylinder head.

As previously mentioned, the arrangement of the annular surface 33 and the sealing face 35, and more particularly, the flow control projection 41, influence the trajectory of the fuel spray issuing from the delivery port 30. Fuel vapour and smaller fuel droplets in the fuel spray are drawn towards the flow control projection 41 as schematically depicted by flow lines 51 in FIG. 1 of the drawings, and are hence guided to a region adjacent the spark gap 49. The fuel spray is drawn towards the flow control projection 41 and follows a path defined by the profile of the projection 41, as depicted by the flow lines 51. Such an influence on the trajectory of the fuel spray arises from the fluid flow phenomenon known as the Coanda Effect, as discussed in the aforementioned U.S. Pat. No. 5,551,638. The trajectory of small fuel droplets is influenced by the flow control projection 41 by virtue of their high surface area to volume ratio. Such droplets typically exist in ratios of gas to liquid in the order of unity, numerically 1.0.

At lower ratios of gas to fluid, such as in the order of, numerically 0.1, the fuel droplets can be large enough to resist the influence of the flow control projection 41 by virtue of their momentum and follow a trajectory depicted by flow lines 53. Hence, where in the fuel spray issuing from the delivery port 30 there is a greater ratio of gas to fluid, the flow control projection 41 has a more significant effect on the shaping of the fuel plume. Conversley, where in the fuel spray there is a lesser ratio of gas to fluid, the exit surfaces of the delivery port 30 have a more significant effect on the shaping of the fuel plume.

Accordingly, fuel droplets and vapour are drawn towards a region adjacent the spark gap 49 while the larger fuel droplets are excluded from entering this region where they are likely to impinge on the electrodes, particularly the secondary electrode 47, in the immediate vicinity of the spark gap 49. Hence, the projection contributes to the establishment of a desired repeatable air/fuel ratio in the region immediately downstream of the delivery port 30. This is conducive to enabling a repeatable and reliable ignition process, in that the insulation and quenching effects due to large fuel droplets in the spark gap 49 are avoided.

A particular advantage of the arrangement of the embodiment shown in FIG. 1, where the spark gap 49 is in an axial disposition, is that the size of the gap 49 reduces upon opening of the delivery port 30 and increases upon closing of the delivery port 30. This is advantageous, as the spark gap 49 closes when the injector is actuated. Consequently, the voltage potential required to strike the ignition arc is reduced. The arc is likely to remain established when the delivery port 30 closes and the spark gap 49 opens to its maximum extent.

As mentioned hereinbefore, the profile of the flow control projection 41 shown in FIG. 1 of the drawings is considered to be particularly advantageous, although other profiles for the flow control projection are certainly possible. One such other profile is illustrated in the device 10 shown in FIG. 2 of the drawings. A further difference with the arrangements shown in FIG. 2 of the drawings is that the spark gap 49 between the primary electrode 45, defined by flow control projection 41, and the secondary electrode 47 is of radial disposition as opposed to the axial disposition in the embodiment shown in FIG. 1. In certain applications, the provision of a radial spark gap 49 may in fact be more desirable than an axial gap. This may particularly be the case depending upon the shape and configuration of the flow control projection 41 which is used. Because the smaller fuel droplets and fuel vapour are attracted towards the surface of the projection 41 (as alluded to hereinbefore), under certain operating conditions, some of the droplets and fuel vapour may contact the surface and run downwardly along the surface towards the lowermost end of the projection 41. This may result in some heavier fuel droplets forming at the lowermost end of the projection 41 which may impinge on the electrodes 45, 47 in the instance where the spark gap 49 is arranged axially with respect to the projection 41. Accordingly, the provision of a radial spark gap 49 in such applications may be preferred as it would avoid any detrimental effects produced by a thin layer of fluid moving along the surface of the projection 41.

Further, and as alluded to hereinbefore, the provision of a radial spark gap may ensure that the spark traverses a range of air-fuel ratios which are present in the cylinder. Hence, such an arrangement may increase the likelihood of an ignition event occurring.

Figure 3:
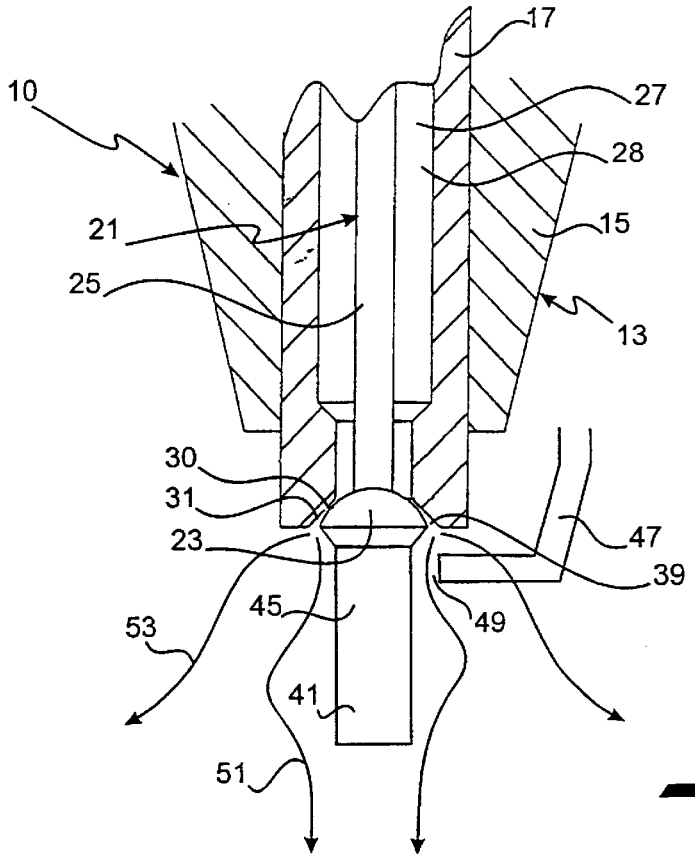
FIG. 3 is also a view similar to FIG. 1, except that it is in respect of a combined injection and ignition means according to a third embodiment.

In the first and second embodiments, the spark gap 49 is located adjacent the lowermost end of the flow control projection 41. An alternative arrangement is illustrated in FIG. 3 of the drawings where the secondary electrode 47 is located closer to the delivery port 30 in order to also facilitate modification of the combustion deposits which may form in the vicinity of the divergent nozzle 39 formed at the delivery port 30. In this embodiment, the deposits are removed by electrical erosion arising from the action of the spark in the spark gap 49. For this purpose, more than one secondary electrode 47 may also be provided to increase such erosion effects. Where there are a multitude of secondary electrodes 47, they may be conveniently disposed circumferentially about the primary electrode 45. Modification or removal of deposit formations in this way serves to maintain the integrity of the valve exit surfaces of the delivery port 30.

Further, in certain applications where the flow control projection 41 may not be provided on the device 10 and the spark gap may be provided between the secondary electrode 47 and the valve member 23, the location of the secondary electrode 47 as shown in FIG. 3 is one possible arrangement thereof which would be conducive to enabling reliable and repeatable ignition. In such an arrangement, even though no projection is provided, the two fluid nature of the fuel spray issuing from the delivery port 30 and the nature of the exit surfaces at the delivery port 30 result in some 'necking in' of the fuel spray downsteam of the nozzle due to the presence of a low pressure region immediately beneath and adjacent the valve member 23. This is facilitated by the fine atomisation of the fuel droplets provided by the dual fluid delivery injector. Further, the region beneath the valve member 23 is essentially protected from larger, heavier droplets of fuel and so the establishment of a repeatable air/fuel ratio which is conducive to ignition is generally able to be ensured in the region immediately downstream of the delivery port 30.

Figure 2:
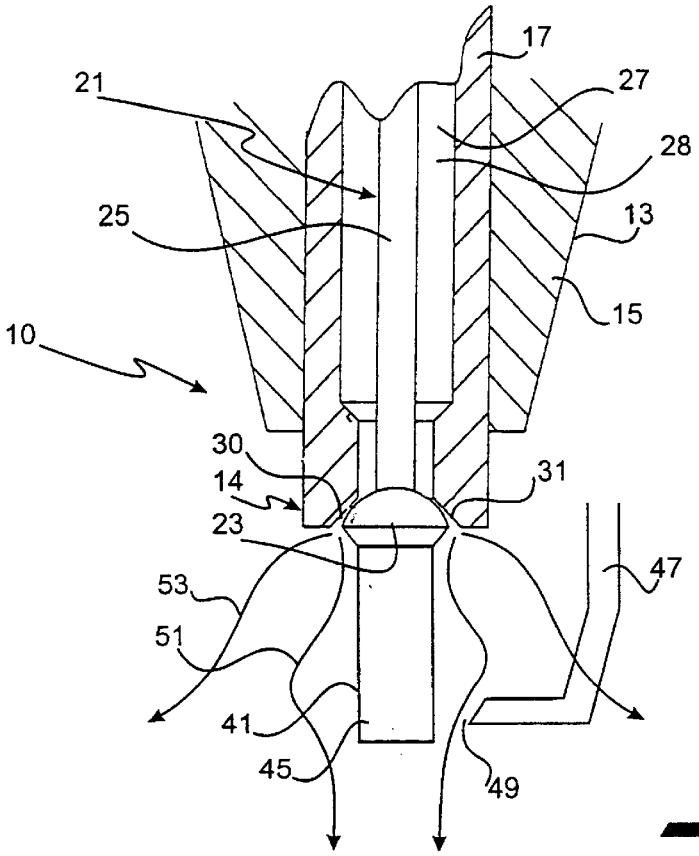
FIG. 2 is a view similar to FIG. 1, except that it is in respect of a combined injection and ignition means according to a second embodiment.

In the embodiments illustrated in FIGS. 1, 2, and 3 of the drawings, the fuel entrained in a gas was delivered to the combustion chamber along a flow path defined by passage 27 disposed about the valve stem 25. Other suitable arrangements are however possible. One such other arrangement is shown in the embodiment illustrated in FIGS. 4 and 5 of the drawings. In this embodiment, the valve stem 25 is hollow so as to provide a flow passage 61 along which the fuel and/or gas can be delivered. Openings 63 can be provided in the wall of the valve stem 25 to permit the gaseous flow to pass from the passage 61 to an outer zone 65 from where it can be delivered upon opening of the delivery port 30. Such a fuel delivery injector having a hollowed valve stem is described, for example, in the Applicant's U.S. Pat. No. RE 36,768, the contents of which are included herein by way of reference.

Figure 4:
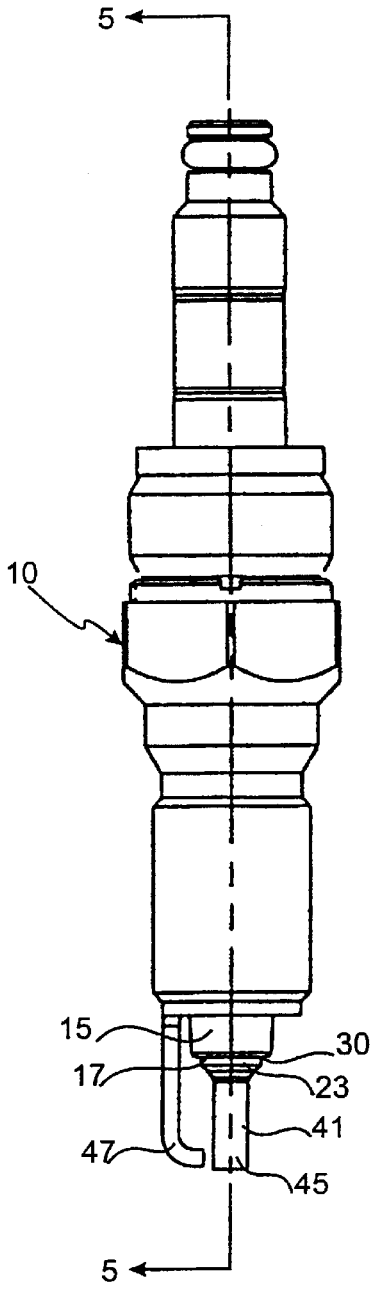
FIG. 4 is a side view of a combined injection and ignition means according to a fourth embodiment.
Figure 5:
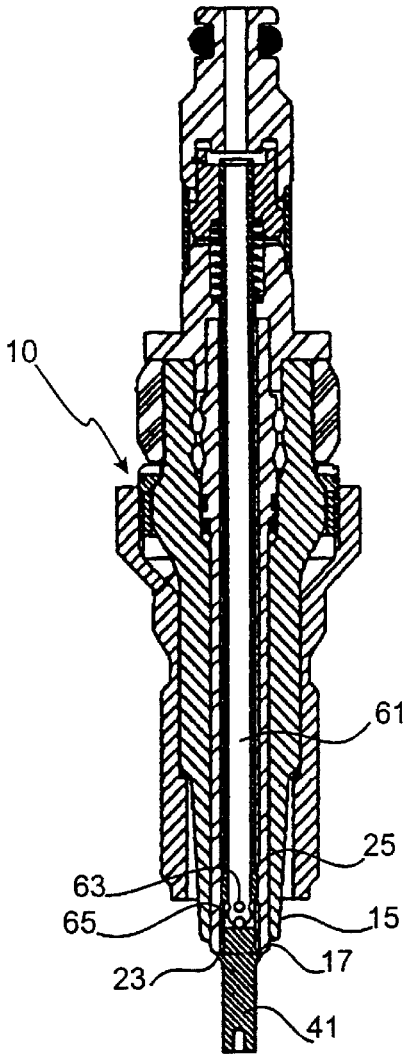
FIG. 5 is a sectional view on line 5—5 of FIG. 4.
Figure 6:
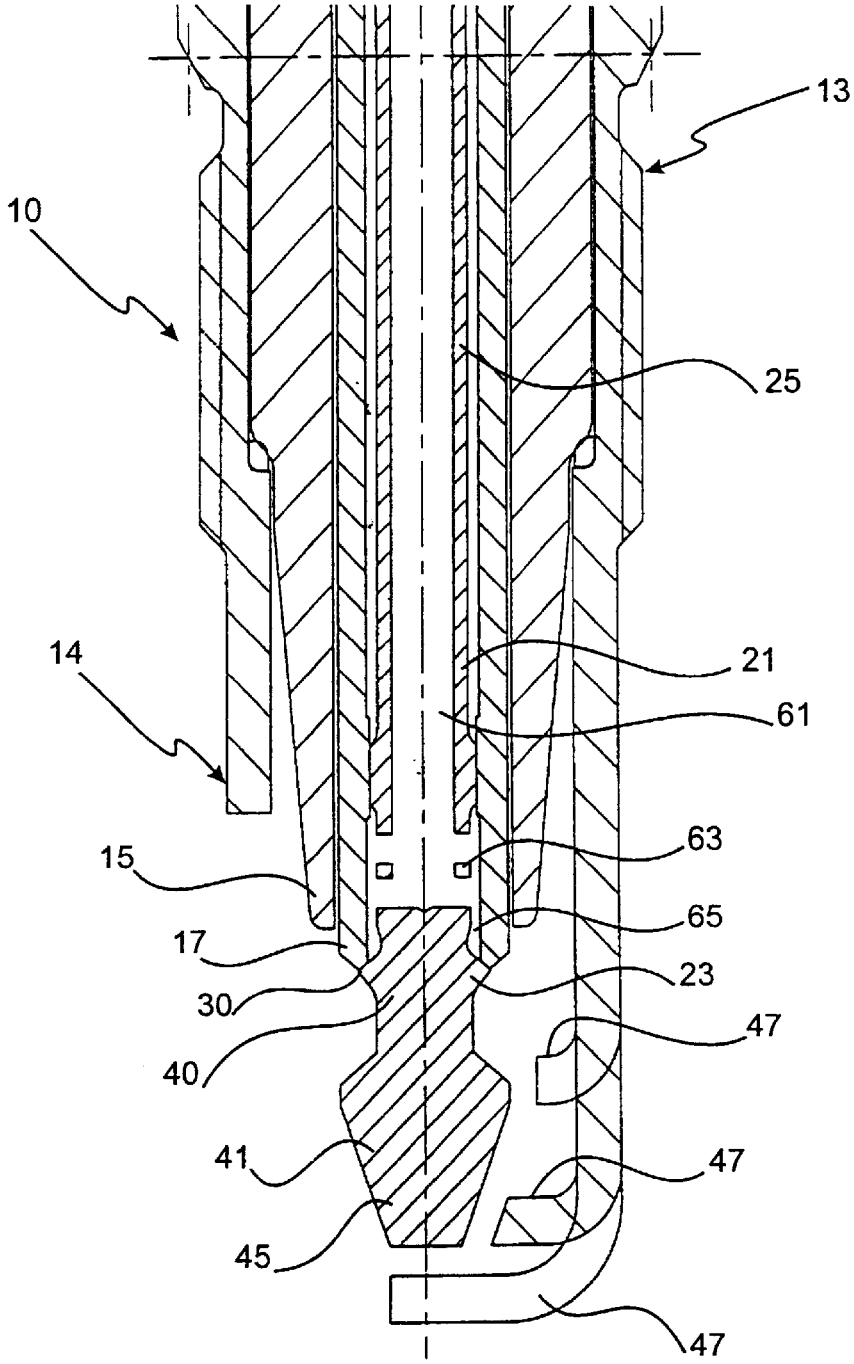
FIG. 6 is a fragmentary schematic view of the discharge end of a combined injection and ignition means according to a fifth embodiment.

The embodiment shown in FIG. 6 is similar to the embodiment of FIGS. 4 and 5, except that the secondary electrode 47 is depicted in various possible positions. In each of FIGS. 4, 5 and 6, similar numbering has been used for components which correspond to those as depicted in the embodiments shown in FIGS. 1, 2 and 3.

In the various embodiments described hereinbefore, the primary electrode 45 defined by the flow control projection 41 may accommodate a resistive coil or it may be formed entirely of a resistive material attached to the valve member 23, so that the rate of change of current and voltage is reduced when an arc is struck between the electrodes during an ignition event. This may be beneficial as it can reduce electromagnetic emissions or interference which may interfere with nearby electronic circuitry or electrical systems. In one particular arrangement, the electrode may comprise a partially conductive ceramic with resistance in the order of 5 to 50 kilo-ohms. A metal coating would typically be provided on the end of the ceramic electrode. A sphere or other suitable formation of a noble metal (such as platinum or iridium) can be welded onto the metal coating to provide the required service life having regard to electrical erosion by the sparking arc.

Further, the secondary electrode 47 may be connected to a secondary voltage potential by way of a resistive path or element 54 as is shown in FIG. 1. Such a resistive path may similarly limit the rate of change of voltage and current at the spark gap 49 when an arc is struck during an ignition event.

From the foregoing, it is evident that the combined injection and ignition means according to the various embodiments provides a very effective arrangement for delivering fuel to a spark gap in a manner which provides conditions conducive to a reliable and repeatable ignition process. In particular, an advantage of the combined injection and ignition means as described hereinbefore is that it enables the spark gap 49 of the device 10 to be arranged in a region where vapour and smaller fuel droplets are encouraged or made to flow. Further, larger fuel droplets which are not as conducive to the establishment of a reliable spark event are made to avoid the spark gap 49. Accordingly, the devices according to the present invention enable a spark gap 49 to be provided in a region downstream of the delivery port 30 where there is a high tolerance to ignition. As a result, certain advantages may be realised over prior art arrangements wherein significant challenges arise in regard to providing a suitable sparking means in such a high ignition tolerant region. That is, the present invention provides considerable flexibility as to where the spark gap 49 could be located. In particular, a combined injection and ignition means as described hereinbefore which functions according to a dual fluid fuel injection process is tolerant to wide variations in the location of the spark gap 49 downstream of the device due to the desired repeatable air/fuel ratio which is produced in the region immediately downstream thereof.

Also noteworthy is that, with the present invention, ignition is occurring off the inner part of the fuel spray plume as opposed to the outer part thereof (ie. the spark gap is located closer to the axial axis of the fuel delivery injector). This is best seen from a consideration of FIGS. 1 and 2. This is generally different to existing prior art arrangements in which ignition normally occurs off the outer part or periphery of the fuel spray plume (ie. spaced outwardly or radially further from the axial centreline of the delivery injector). Further, the arrangements according to the present invention also enable the ignition to be affected directly off the original fuel spray plume which has exited the delivery port 30. That is, in many prior art arrangements, the ignition event does not occur until after the fuel charge has been deflected or reflected off another component within the combustion chamber (eg. a cavity or bowl in the piston crown). As alluded to hereinbefore, arrangements according to the present invention instead allow ignition to occur shortly after the metered quantity of fuel has been delivered from the delivery port 30.

The nature of the combined injection and ignition means is of course not restricted to the arrangements as shown in the various embodiments discussed hereinbefore and other suitable arrangements of different construction may of course be employed. For example, the combined injection and ignition means may be of a two-part construction such as those arrangements described in the Applicant's co-pending Australian provisional patent application PQ3501 and PQ3502, which were filed on 18th Oct. 1999, the contents of which are included herein by reference.

It should, however, be understood that the scope of the invention is not limited to the scope of the various embodiments described. In particular, it should be understood that the invention is not limited to a device which provides a combined fuel injection and ignition means. The invention can, for example, provide merely a fuel injection means which operates in association with an independent ignition means such as a suitable spark plug. Further, although primarily discussed with regard to outwardly opening or poppet-type delivery injector arrangements, it is envisaged that certain aspects of the present invention may be applicable to suitably designed inwardly opening or pintle-type delivery injector or valve arrangements.

Furthermore, it is to be appreciated that the invention is equally applicable whether predominantly liquid fuels or gaseous fuels such as LPG, LNG and CNG are delivered thereby.

Whilst aspects of the invention have in the main been described with reference to a single path combined ignition and injection device wherein fuel (and air) and high voltage ignition current follow substantially the same path, it is to be appreciated that the present invention is equally applicable where fuel and high voltage ignition current do not follow a common path through the ignition and injection device.

The invention is applicable to all types of internal combustion engines, whether of the two or four stroke type, but has particular applicability to direct injected four stroke engines where there are often challenges to overcome in regard to the limited space available in the cylinder head to accommodate various components, elements and features. Obviously, the embodiments of the present invention avoid the need to have a separate fuel delivery injector and a separate sparking means in the cylinder head corresponding to a combustion chamber of an engine.

Throughout the specification, unless the context requires otherwise, the word "comprise" or variations such as "comprises" or "comprising", will be understood to imply the inclusion of a stated integer or group of integers but not the exclusion of any other integer or group of integers.

What is claimed is:

1. A fuel delivery injector for a spark-ignition internal combustion engine, the fuel delivery injector comprising means defining a flow path for delivery of a fuel entrained in a gas to a combustion chamber of the engine, the flow path having a delivery port through which the fuel is delivered into the combustion chamber as a spray of fuel droplets and vapour, the delivery port being defined between a valve seat and a valve member movable with respect to the valve seat for opening and closing the delivery port, the delivery injector being configured to influence the trajectory of the fuel spray whereby smaller fuel droplets and vapour in the fuel spray are caused to flow towards a spark gap in close proximity to the downstream end of the delivery port and whereby larger fuel droplets are not so caused to flow towards the spark gap.

2. A fuel delivery injector according to claim 1 further comprising a flow control means disposed outwardly of the delivery port in the direction of issuance of the fuel spray, the flow control means being configured and positioned to influence the trajectory of the fuel spray whereby smaller fuel droplets and vapour in the fuel spray are caused to flow towards the spark gap in the vicinity of the control means.

3. A fuel delivery injector according to claim 2 wherein the flow control means comprises a flow control projection provided on the valve member and extending outwardly therefrom beyond the delivery port.

4. A fuel delivery injector according to claim 3 wherein the flow control projection is mounted on the valve member.

5. A fuel delivery injector according to claim 4 wherein the flow control projection is detachably connected to the valve member.

6. A fuel delivery injector according to claim 3 wherein the flow control projection is configured as part of the valve member.

7. A fuel delivery injector according to claim 3 wherein the flow control projection is so configured and positioned that smaller droplets and vapour are guided by the profile of the projection.

8. A fuel delivery injector according to claim 1 wherein a generally low pressure area is in use developed immediately beneath the valve member of the fuel delivery injector and wherein smaller fuel droplets and vapour are drawn inwardly towards the spark gap following their delivery into the combustion chamber due to the presence of the generally low pressure area.

9. A fuel delivery injector according to claim 1 wherein the flow control projection defines a first electrode for co-operating with a second electrode to define the spark gap.

10. A fuel delivery injector according to claim 1 wherein the valve member is configured as a first electrode for co-operating with a second electrode to define the spark gap.

11. A fuel delivery injector according to claim 9 wherein the first electrode is a primary electrode.

12. A fuel delivery injector according to claim 9 wherein the first and second electrodes are disposed relative to one another such that the spark gap defined therebetween provides an axial gap.

13. A fuel delivery injector according to claim 9 wherein the electrodes are disposed relative to one another such that the spark gap defined therebetween provides a radial gap.

14. A fuel delivery injector according to claim 13 wherein a plurality of said second electrodes are circumferentially spaced about the first electrode.

15. A fuel delivery injector according to claim 1 arranged to deliver fuel entrained in gas directly into the combustion chamber of the engine.

16. A fuel delivery injector according to claim 1 wherein the injector is of the outwardly opening or poppet type.

17. A fuel delivery injector according to claim 1 wherein ignition at the spark gap occurs directly off the fuel spray issuing from the delivery port.

18. A fuel delivery injector according to claim 1 wherein ignition occurs off the inner part of the fuel spray.

19. A fuel delivery injector according to claim 1 wherein the delivery port comprises an annular passage divergent in the direction of flow of the fuel entrained in the gas.

20. A fuel delivery injector according to claim 1 wherein the annular passage defining the delivery port includes a constricted section defining a minimum choke area and a divergent section downstream of the constricted section defining a divergent nozzle.

21. A fuel delivery injector according to claim 20 wherein the valve seat has an annular surface of frusto-conical form to provide the divergent section.

22. A fuel delivery injector according to claim 20 wherein the valve member has a sealing face of arcuate formation confronting the valve seat.

23. A fuel delivery injector according to claim 1, wherein the fuel spray trajectory is affected at least in part based on the Coanda Effect flow phenomenon.

24. A combined fuel injection and ignition means for a spark-ignition internal combustion engine, the combined fuel injection and ignition means comprising means defining a flow path for delivery of a fuel entrained in a gas to a combustion chamber of the engine, the flow path having a delivery port through which the fuel is delivered into the combustion chamber as a spray of fuel droplets and vapour, the delivery port being defined between a valve seat and a valve member movable with respect to the valve seat for opening and closing the delivery port, a first electrode for co-operation with a second electrode to form a spark gap, and a flow control means for influencing the trajectory of the fuel spray issuing from the delivery port whereby smaller fuel droplets and vapour in the fuel, spray are caused to flow towards the spark gap and whereby larger fuel droplets are not so caused to flow towards the spark gap.

25. A combined fuel injection and ignition means according to claim 24 wherein the flow control means comprises a flow control projection provided on the valve member and extending outwardly of the delivery port in the direction of issuance of the fuel spray.

26. A combined fuel injection and ignition means according to claim 25 wherein the flow control projection defines said first electrode.

27. A combined fuel injection and ignition means according to claim 24 wherein the flow control means comprises the delivery port.

28. A combined fuel injection and ignition means according to claim 25 wherein the flow control means further comprises the delivery port.

29. A combined fuel injection and ignition means according to claim 27 wherein the valve member defines said first electrode.

30. A combined fuel injection and ignition means according to claim 24 further comprising said second electrode.

31. A combined fuel injection and ignition means according to claim 24 wherein ignition at the spark gap occurs directly off the fuel spray issuing from the delivery port.

32. A combined fuel injection and ignition means according to claim 31 wherein ignition occurs oft the inner part of the fuel spray.

33. A combined fuel injection and ignition means according to claim 24, wherein the fuel spray trajectory is affected at least in part based on the Coanda Effect flow phenomenon.

34. A combined fuel injection and ignition means for a spark-ignition internal combustion engine, the combined fuel injection and ignition means comprising means defining a flow path for delivery of a fuel entrained in a gas to a combustion chamber of the engine, the flow path having a delivery port through which the fuel is delivered into the combustion chamber as a spray of fuel droplets and vapour, the delivery port being defined between a valve seat and a valve member movable with respect to the valve seat for opening and closing the delivery port, a flow control projection arranged on the valve member and extending outwardly of the delivery port in the direction of issuance of the fuel spray, the flow control projection defining a first electrode which in co-operation with a second electrode forms a spark gap, the delivery port and/or the control projection being configured and positioned to influence the trajectory of the fuel spray whereby smaller fuel droplets and vapour in the fuel spray are caused to flow towards the spark gap and whereby larger fuel droplets are not so caused to flow towards the spark gap.

35. A combined fuel injection and ignition means for a spark-ignition internal combustion engine according to claim 34, wherein the fuel spray trajectory is affected at least in part based on the Coanda Effect flow phenomenon.

36. A method of injecting fuel into an internal combustion engine having a combustion chamber and a spark gap for spark-ignition of the fuel delivered into the combustion chamber, the method comprising the acts of: delivering a metered quantity of fuel entrained in a gas to the combustion chamber through a selectively openable delivery port to provide a fuel spray issuing from the port when opened; and controlling the fuel spray to influence fuel vapour and smaller fuel droplets to flow towards the spark gap while not so influencing larger droplets whereby the larger droplets continue on trajectories which do not lead to the spark gap.

37. A method according to claim 36 wherein the fuel spray is controlled by subjecting it to a flow control means positioned downstream of the delivery port.

38. A method according to claim 36 wherein the fuel spray is controlled or further controlled by the configuration of the delivery port.

39. A method of injecting fuel into an internal combustion engine having a combustion chamber and a spark gap for spark-ignition of the fuel delivered into the combustion chamber according to claim 36, wherein the fuel spray trajectory is affected at least in part based on the Coanda Effect flow phenomenon.

* * * * *